US009825366B2

(12) United States Patent
Li et al.

(10) Patent No.: US 9,825,366 B2
(45) Date of Patent: Nov. 21, 2017

(54) PRINTED CIRCUIT BOARD ANTENNA AND PRINTED CIRCUIT BOARD

(71) Applicant: Huawei Technologies Co., Ltd., Shenzhen (CN)

(72) Inventors: Zhenghao Li, Shenzhen (CN); Yao Lan, Shenzhen (CN); Lintao Jiang, Shenzhen (CN); Jie Qi, Shenzhen (CN); Yi Zhang, Shenzhen (CN); Yundi Yao, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 317 days.

(21) Appl. No.: 14/573,152

(22) Filed: Dec. 17, 2014

(65) Prior Publication Data

US 2015/0097752 A1 Apr. 9, 2015

Related U.S. Application Data

(63) Continuation of application No. PCT/CN2014/070043, filed on Jan. 2, 2014.

(30) Foreign Application Priority Data

Jan. 6, 2013 (CN) ..... 2013 1 0003161

(51) Int. Cl.
*H01Q 9/42* (2006.01)
*H01Q 9/04* (2006.01)
(Continued)

(52) U.S. Cl.
CPC ..... *H01Q 9/0407* (2013.01); *H01Q 1/38* (2013.01); *H01Q 1/48* (2013.01); *H01Q 5/321* (2015.01); *H01Q 5/378* (2015.01); *H01Q 9/42* (2013.01)

(58) Field of Classification Search
CPC ..... H01Q 9/0407; H01Q 9/42; H01Q 5/321
See application file for complete search history.

(56) References Cited

U.S. PATENT DOCUMENTS 6,768,472 B2 * 7/2004 Alexopoulos ..... H03H 7/40 330/144
7,079,079 B2 * 7/2006 Jo ..... H01Q 1/243 343/700 MS (Continued)

FOREIGN PATENT DOCUMENTS

CN 1925223 A 3/2007
CN 101320837 A 12/2008

(Continued)

OTHER PUBLICATIONS

Partial English Translation and Abstract of Japanese Patent Application No. JPA2010-074344, Apr. 6, 2016, 31 pages.

(Continued)

*Primary Examiner* — Dameon E Levi
*Assistant Examiner* — Hasan Islam
(74) *Attorney, Agent, or Firm* — Conley Rose, P.C.

(57) ABSTRACT

A printed circuit board antenna and a printed circuit board are disclosed. The printed circuit board antenna includes a feeding part having at least one first branch; a coupling interdigital part having at least one second branch, where a gap is formed between the first branch and the second branch; a grounding part, where a gap is formed between the grounding part and the feeding part, a gap is formed between the grounding part and the coupling interdigital part, an opening is provided on the grounding part, and a feeding point of the feeding part extends out from the opening. The embodiments of the present invention resolve a problem of relatively low efficiency when high-frequency bandwidth of (Continued)

an antenna is relatively wide, implementing that efficiency meets a product requirement in an entire range of bandwidth.

20 Claims, 9 Drawing Sheets

(51) Int. Cl.

| | |
|---|---|
| ***H01Q 1/38*** | (2006.01) |
| ***H01Q 1/48*** | (2006.01) |
| ***H01Q 5/321*** | (2015.01) |
| ***H01Q 5/378*** | (2015.01) |

(56) References Cited

U.S. PATENT DOCUMENTS

| | | | | |
|---|---|---|---|---|
| 8,193,973 | B2 * | 6/2012 | Morton | H01P 1/2005 29/600 |
| 2002/0122010 | A1 | 9/2002 | McCorkle | |
| 2006/0061509 | A1 | 3/2006 | Chen | |
| 2012/0026064 | A1 | 2/2012 | Lee et al. | |

FOREIGN PATENT DOCUMENTS

| | | | |
|---|---|---|---|
| CN | 101345337 | A | 1/2009 |
| CN | 201307639 | Y | 9/2009 |
| CN | 102064384 | A | 5/2011 |
| CN | 102147779 | A | 8/2011 |
| CN | 102157779 | A | 8/2011 |
| CN | 102377022 | A | 3/2012 |
| EP | 0790663 | A1 | 8/1997 |
| EP | 0831547 | A2 | 3/1998 |
| EP | 2242144 | A2 | 10/2010 |
| JP | H09219619 | A | 8/1997 |
| JP | H1013139 | A | 1/1998 |
| JP | 2010074344 | A | 4/2010 |
| JP | 2011061638 | A | 3/2011 |
| WO | 2010116373 | A1 | 10/2010 |

OTHER PUBLICATIONS

Partial English Translation and Abstract of Japanese Patent Application No. JPH09-219619, Apr. 6, 2016, 12 pages.
Partial English Translation and Abstract of Japanese Patent Application No. JPH10-013139, Apr. 6, 2016, 14 pages.
Foreign Communication From a Counterpart Application, Japanese Application No. 2015-521974, Japanese Office Action dated Feb. 2, 2016, 3 pages.
Foreign Communication From a Counterpart Application, Japanese Application No. 2015-521974, English Translation of Japanese Office Action dated Feb. 2, 2016, 4 pages.
Partial English Translation and Abstract of Chinese Patent Application No. CN1925223, Nov. 29, 2016, 4 pages.
Partial English Translation and Abstract of Chinese Patent Application No. CN102064384, Nov. 29, 2016, 6 pages.
Foreign Communication From a Counterpart Application, Chinese Application No. 201310003161.1, Chinese Office Action dated Oct. 24, 2016, 12 pages.
Partial English Translation and Abstract of Chinese Patent Application No. CN102157779, Oct. 9, 2015, 12 pages.
Foreign Communication From a Counterpart Application, Chinese Application No. 201310003161.1, Chinese Office Action dated Aug. 25, 2015, 10 pages.
Foreign Communication From a Counterpart Application, European Application No. 14735349.4, Extended European Report dated Jun. 18, 2015, 6 pages.
Partial English Translation and Abstract of Chinese Patent Application No. CN101345337A, Jan. 27, 2015, 3 pages.
Partial English Translation and Abstract of Chinese Patent Application No. CN102147779A, Jan. 27, 2015, 5 pages.
Foreign Communication From a Counterpart Application, PCT Application No. PCT/CN2014/070043, English Translation of International Search Report dated Apr. 3, 2014, 2 pages.
Foreign Communication From a Counterpart Application, PCT Application No. PCT/CN2014/070043, Written Opinion dated Apr. 3, 2014, 4 pages.

* cited by examiner

PRINTED CIRCUIT BOARD ANTENNA AND PRINTED CIRCUIT BOARD

CROSS-REFERENCE TO RELATED APPLICATIONS

This application is a continuation of International Application No. PCT/CN2014/070043, filed on Jan. 2, 2014, which claims priority to Chinese Patent Application No. 201310003161.1, filed on Jan. 6, 2013, both of which are hereby incorporated by reference in their entireties.

TECHNICAL FIELD

Embodiments of the present invention relate to wireless communications technologies, and in particular, to a printed circuit board antenna and a printed circuit board.

BACKGROUND

With the rapid development of mobile communications technologies, a terminal product has increasingly diverse and complex functions, which imposes harsher and stricter requirements on a terminal antenna. A terminal product also has increasingly higher integration, and second generation telecommunications technology (2G), third generation telecommunications technology (3G), and the like are almost needed to simultaneously exist in a same type of product, which requires the antenna to cover all needed frequency bands.

At present, a common printed circuit board antenna is a conductive pattern formed on the printed circuit board, and implements a high-frequency and low-frequency double resonance by adding a matching circuit. FIG. 1 shows a schematic structural diagram of a printed circuit board antenna in the prior art, and the printed circuit board antenna includes a feeding part 11 and a low-frequency coupling radiator 12. The low-frequency coupling radiator 12 replaces the matching circuit to implement expansion of a low frequency, and contacts with a printed circuit board 10 by using a grounding point 120 in a grounding manner; and the feeding part 11 includes a feeding point 110, and electrically connects to a radio frequency circuit on the printed circuit board 10 by using the feeding point 110.

Although the foregoing printed circuit board antenna structure resolves a problem that a low frequency needs to be implemented by using a matching circuit and that low-frequency bandwidth is narrow, when high-frequency bandwidth is relatively wide, there are still some difficulties in improving efficiency.

SUMMARY

Embodiments of the present invention provide a printed circuit board antenna and a printed circuit board to resolve a problem of relatively low efficiency when high-frequency bandwidth is relatively wide, so as to implement that efficiency meets a product requirement in an entire range of bandwidth.

According to a first aspect, an embodiment of the present invention provides a printed circuit board antenna, and the printed circuit board antenna includes a feeding part having at least one first branch; a coupling interdigital part having at least one second branch, where a gap is formed between the first branch and the second branch; and a grounding part, where a gap is formed between the grounding part and the feeding part, a gap is formed between the grounding part and the coupling interdigital part, an opening is provided on the grounding part, and a feeding point of the feeding part extends out from the opening.

In a first possible implementation manner of the first aspect, the feeding part includes a first straight line segment type and the first branch, where the first branch extends out in parallel from one side of the first straight line segment type; and the coupling interdigital part includes a second straight line segment type and the second branch, where the second branch extends out in parallel from one side of the second straight line segment type, and the second branch and the first branch are disposed in an opposite alternation manner.

According to the first possible implementation manner of the first aspect, in a second possible implementation manner, a length of the first branch is equal or unequal to a length of the second branch, a gap distance between the first branch and the second branch is equal or unequal, a gap distance between the grounding part and the feeding part is equal or unequal, and a gap distance between the grounding part and the coupling interdigital part is equal or unequal.

According to the first aspect, and any one of the first to the second possible implementation manners of the first aspect, in a third possible implementation manner, the grounding part is a ring with the opening and surrounds the outside of the feeding part and the coupling interdigital part.

According to the third possible implementation manner of the first aspect, in a fourth possible implementation manner, a grounding point is further disposed on the outside of the grounding part.

According to a second aspect, an embodiment of the present invention provides a printed circuit board, and the printed circuit board includes the printed circuit board antenna provided in the foregoing embodiment of the present invention.

In a first possible implementation manner of the second aspect, a microstrip feeder is configured on the printed circuit board, and the microstrip feeder is electrically connected to the feeding point. According to the first possible implementation manner of the second aspect, in a second possible implementation manner, an impedance characteristic of the microstrip feeder may be 50 ohms.

According to a third aspect, an embodiment of the present invention provides a printed circuit board antenna, and the printed circuit board antenna includes a feeding part, a coupling interdigital part, and a grounding part, where the feeding part includes a first straight line segment type, a feeding point, and at least a first branch, where the first branch extends out from one side of the first straight line segment type, and the feeding point is located on an opposite side of the straight line segment type and the first branch; the coupling interdigital part includes a second straight line segment type and at least a second branch, where the second branch extends out from one side of the second straight line segment type, the first branch alternates with the second branch, and there is a gap between the first branch and the second branch; the grounding part is a ring with an opening, where the grounding part surrounds the feeding part and the coupling interdigital part, a gap is formed between the grounding part and the feeding part, a gap is formed between the grounding part and the coupling interdigital part, the feeding point extends out from the opening, and there is a grounding point in a part that the outside of the grounding part contacts with a printed circuit board.

In a first possible implementation manner of the third aspect, a length of the first branch is equal or unequal to a length of the second branch, a gap distance between the first branch and the second branch is equal or unequal, a gap distance between the grounding part and the feeding part is equal or unequal, and a gap distance between the grounding part and the coupling interdigital part is equal or unequal.

In a printed circuit board antenna according to an embodiment of the present invention, coupling radiation is strengthened by adding an interdigital structure, implementing that efficiency meets a product requirement in an entire range of bandwidth and resolving a problem of relatively low efficiency when high-frequency bandwidth is relatively wide.

BRIEF DESCRIPTION OF THE DRAWINGS

To describe the technical solutions in the embodiments of the present invention or in the prior art more clearly, the following briefly introduces the accompanying drawings required for describing the embodiments or the prior art. The accompanying drawings in the following description show some embodiments of the present invention, and a person of ordinary skill in the art may still derive other drawings from these accompanying drawings without creative efforts.

DETAILED DESCRIPTION

To make the objectives, technical solutions, and advantages of the embodiments of the present invention clearer, the following clearly describes the technical solutions in the embodiments of the present invention with reference to the accompanying drawings in the embodiments of the present invention. The described embodiments are a part rather than all of the embodiments of the present invention. All other embodiments obtained by a person of ordinary skill in the art based on the embodiments of the present invention without creative efforts shall fall within the protection scope of the present invention.

Figure 2:
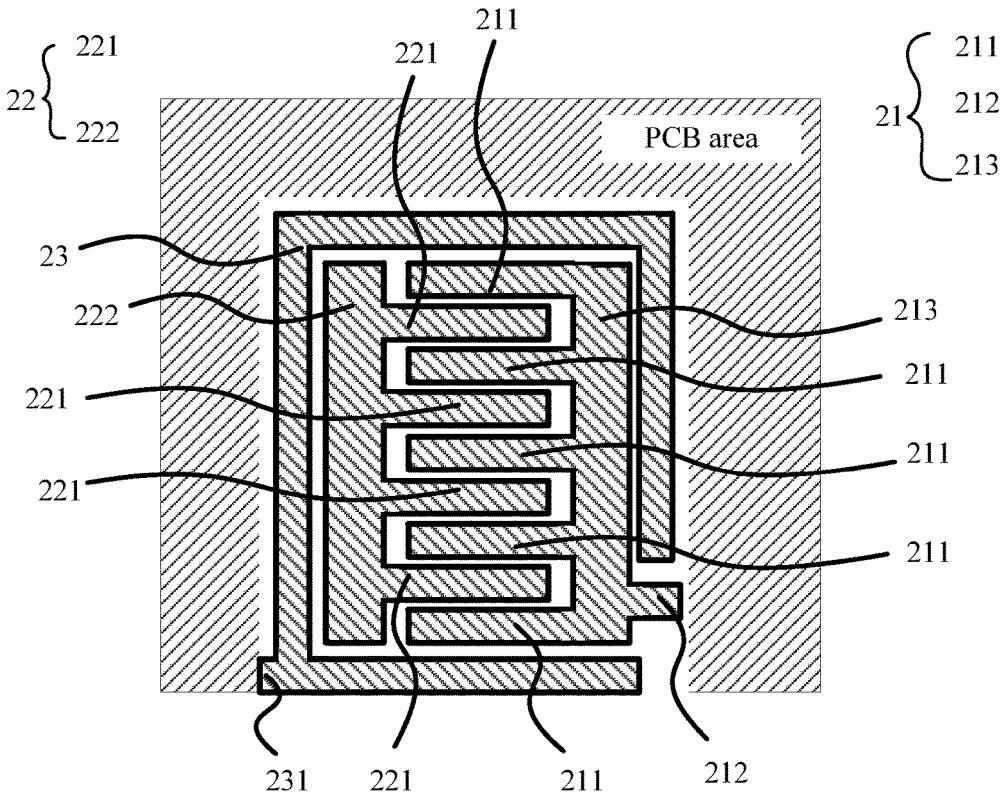
FIG. 2 is a schematic structural diagram of a printed circuit board antenna according to Embodiment 1 of the present invention.

FIG. 2 is a schematic structural diagram of a printed circuit board antenna according to Embodiment 1 of the present invention. This embodiment is applicable to an antenna apparatus, and the antenna apparatus is enabled to improve efficiency, and in particular, high frequency and low-frequency efficiency, on the basis of a small-sized printed antenna, and may implement Long Term Evolution (LTE) full-frequency coverage without matching; in addition, a high-frequency Smith chart is more convergent, and improvement of high-frequency band efficiency is more obvious. With reference to FIG. 2, the printed circuit board antenna includes a feeding part 21, a coupling interdigital part 22, and a grounding part 23.

The feeding part 21 has at least one first branch 211, the coupling interdigital part 22 has at least one second branch 221, and a gap is formed between the first branch 211 and the second branch 221; for the grounding part 23, a gap is formed between the grounding part 23 and the feeding part 21, and a gap is formed between the grounding part 23 and the coupling interdigital part 22, an opening is provided on the grounding part 23, and a feeding point 212 of the feeding part 21 extends out from the opening.

It can be seen from the forgoing description that in a printed circuit board antenna according to an embodiment of the present invention, coupling radiation may be strengthened by adding an interdigital structure, so as to implement that efficiency meets a product requirement in an entire range of bandwidth and resolve a problem of relatively low efficiency when high-frequency bandwidth is relatively wide.

The feeding point 212 is connected to a radio frequency circuit (not shown in the figure). The feeding point 212 is set to extend out from the opening, and in this way, a high-frequency part in whole radiation bandwidth of the antenna may be provided. In addition, in a case in which there is no coupling interdigital part 22 and no grounding part 23, the printed circuit board antenna may be used as a high-frequency antenna.

Based on the technical solution of the foregoing embodiment, preferably, the feeding part 21 includes a straight line segment type 213 and the first branch 211, where each first branch 211 extends out from one side of the straight line segment type 213 (for example, the first branch 211 extends out in parallel from one side of the straight line segment type 213); the coupling interdigital part 22 includes a straight line segment type 222 and the second branch 221, where each second branch 221 extends out from one side of the straight line segment type 222 (for example, the second branch 221 extends out in parallel from one side of the straight line segment type 222), and the second branch 221 and the first branch 211 are disposed in an opposite alternation manner.

Figure 3A:
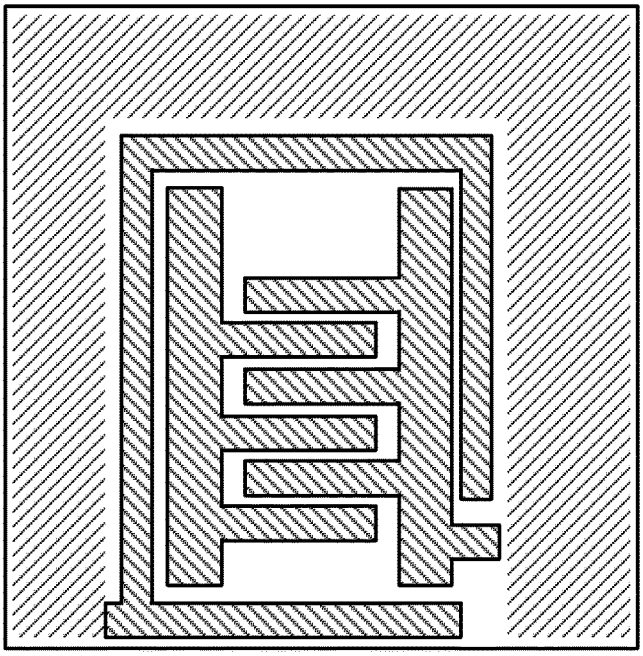
FIGS. 3A, 3B, 3C, 3D, 3E, 3F, 3G, 3H, and FIG. 3I are schematic structural diagrams of a printed circuit board antenna according to other embodiments of the present invention.
Figure 3B:
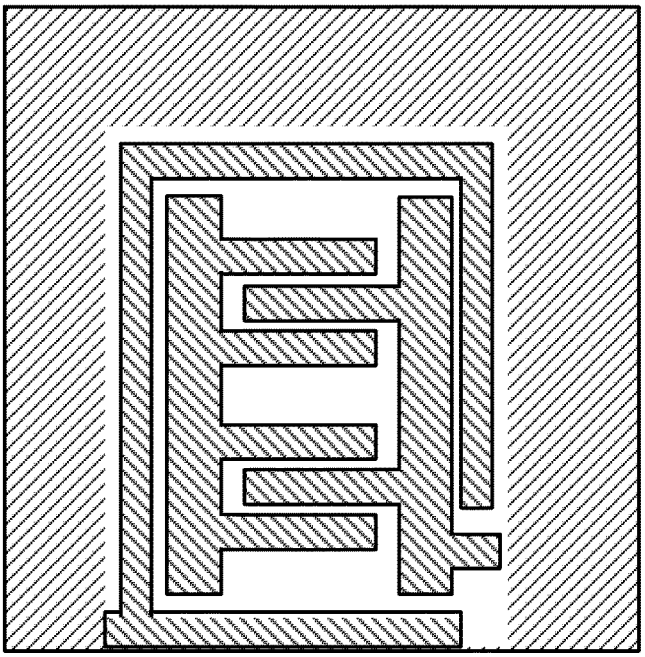
Figure 3C:
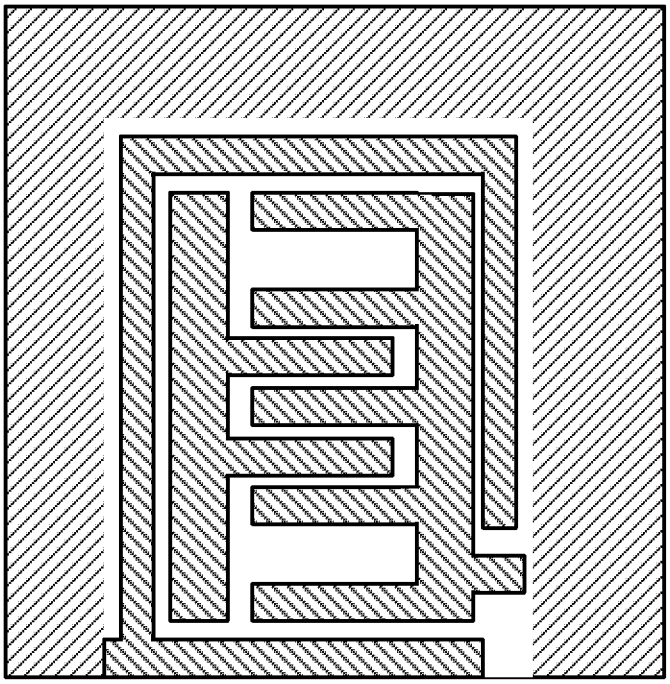
Figure 3D:
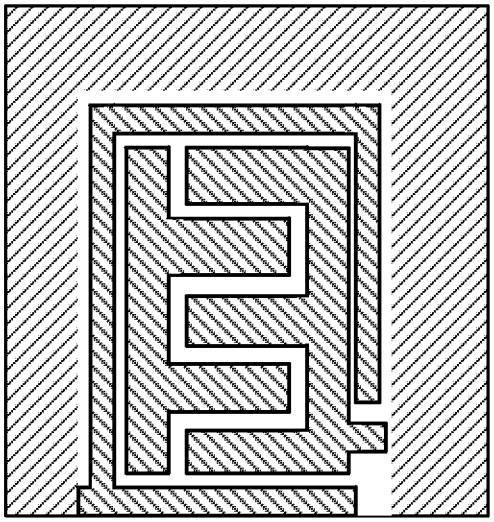
Figure 3E:
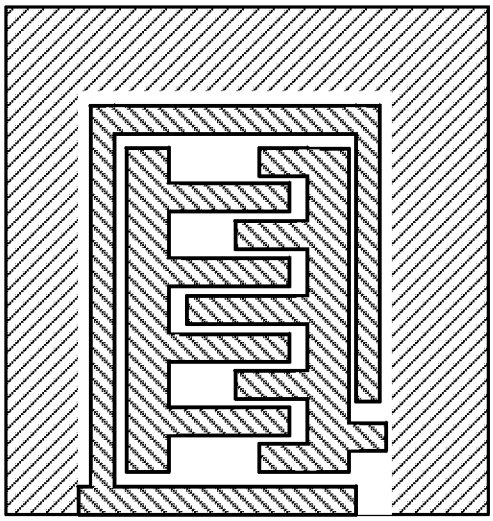
Figure 3F:
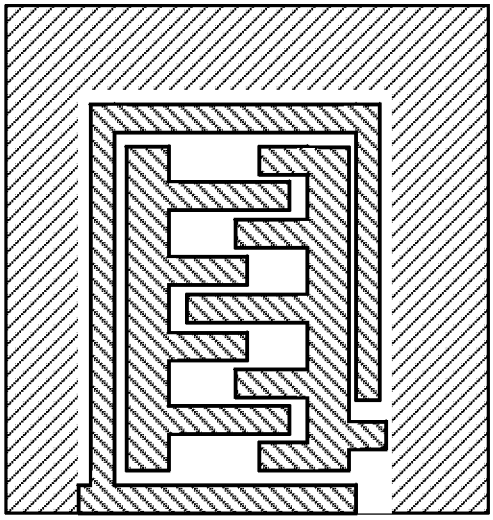

An alternation in this embodiment of the present invention may be only an alternation of one of the first branches 211 and one of the second branches 221. In addition, the number of first branches 211 and the number of second branches 221 may be set to corresponding numbers as required. As shown in FIG. 3A to FIG. 3C, an aim is to tune antenna bandwidth and a resonant point, and a width and a depth of an alternation part may also be set as required. As shown in FIG. 3D to FIG. 3F, an aim is to tune coupling strength. The alternation layout structure enables the printed circuit board antenna in a small size to meet a requirement of high integration of antenna design, and may strengthen coupling radiation and improve high-frequency efficiency.

Figure 3G:
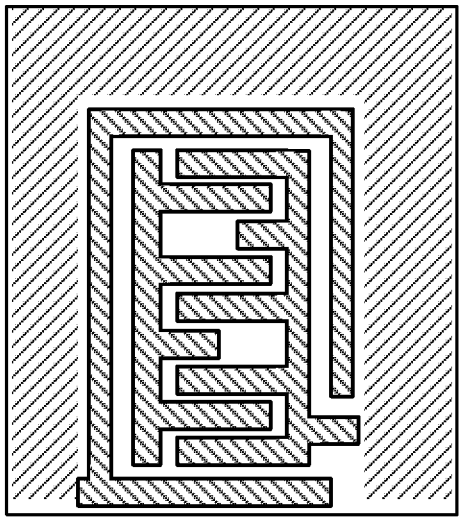
Figure 3H:
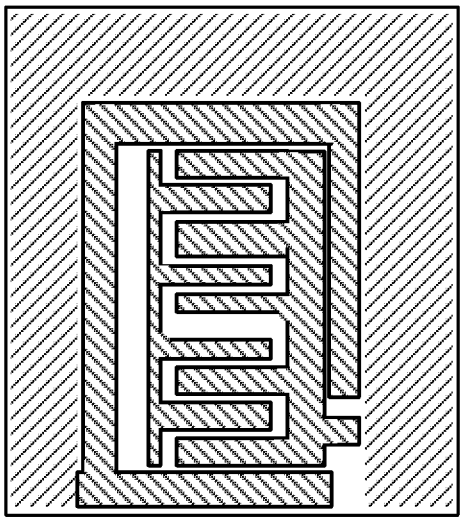
Figure 3I:
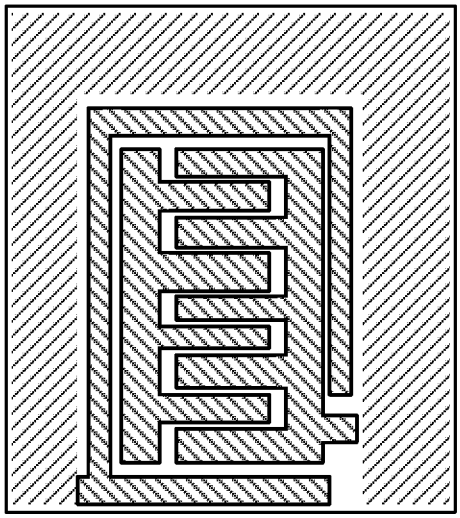

In addition, a length of each first branch 211, a length of each second branch 221, a gap distance between the first branch 211 and the second branch 221, and a gap distance between the grounding part 23, the feeding part 21, and the coupling interdigital part 22 may be designed as an equal or unequal pattern according to actual needs, as shown in FIG. 3G to FIG. 3I.

The grounding part 23 is a ring with the opening and surrounds the outside of the feeding part 21 and the coupling interdigital part 22, but a surrounding form of the grounding part in other embodiments of the present invention is not limited thereto. A grounding point 231 is further disposed on the outside of the grounding part 23, and the grounding point 231 is in contact with copper laid on the printed circuit board.

An embodiment of the present invention further provides a printed circuit board, and the printed circuit board includes a printed circuit board antenna. With reference to FIG. 2, the printed circuit board antenna includes a feeding part 21, a coupling interdigital part 22, and a grounding part 23.

The feeding part 21 has at least one first branch 211, the coupling interdigital part 22 has at least one second branch 221, and a gap is formed between the first branch 211 and the second branch 221; for the grounding part 23, a gap is formed between the grounding part 23 and the feeding part 21, and a gap is formed between the grounding part 23 and the coupling interdigital part 22, an opening is provided on the grounding part 23, and a feeding point 212 of the feeding part 21 extends out from the opening.

It can be seen from the forgoing description that in a printed circuit board antenna according to an embodiment of the present invention, coupling radiation may be strengthened by adding an interdigital structure, so as to implement that efficiency meets a product requirement in an entire range of bandwidth and resolve a problem of relatively low efficiency when high-frequency bandwidth is relatively wide.

The feeding part 21 includes a straight line segment type 213 and the first branch 211, where each first branch 211 extends out from one side of the straight line segment type 213 (for example, the first branch 211 extends out in parallel from one side of the straight line segment type 213); the coupling interdigital part 22 includes a straight line segment type 222 and the second branch 221, where each second branch 221 extends out from one side of the straight line segment type 222 (for example, the second branch 221 extends out in parallel from one side of the straight line segment type 222), and the second branch 221 and the first branch 211 are disposed in an opposite alternation manner.

An alternation in this embodiment of the present invention may be only an alternation of one of the first branches 211 and one of the second branches 221. In addition, the number of first branches 211 and the number of second branches 221 may be set to corresponding numbers as required. As shown in FIG. 3A to FIG. 3C, an aim is to tune antenna bandwidth and a resonant point, and a width and a depth of an alternation part may also be set as required. As shown in FIG. 3D to FIG. 3F, an aim is to tune coupling strength. The alternation layout structure enables the printed circuit board antenna in a small size to meet a requirement of high integration of antenna design, and may strengthen coupling radiation and improve high-frequency efficiency.

In addition, a length of each first branch 211, a length of each second branch 221, a gap distance between the first branch 211 and the second branch 221, and a gap distance between the grounding part 23, the feeding part 21, and the coupling interdigital part 22 may be designed as an equal or unequal pattern according to actual needs, as shown in FIG. 3G to FIG. 3I.

The grounding part 23 is a ring with the opening and surrounds the outside of the feeding part 21 and the coupling interdigital part 22, but a surrounding form of the grounding part in other embodiments of the present invention is not limited thereto. A grounding point 231 is further disposed on the outside of the grounding part 23, and the grounding point 231 is in contact with copper laid on the printed circuit board.

Further or optionally, a microstrip feeder may be configured on the printed circuit board, and the microstrip feeder is electrically connected to the feeding point. Preferably, an impedance characteristic of the microstrip feeder is 50 ohms.

Figure 4:
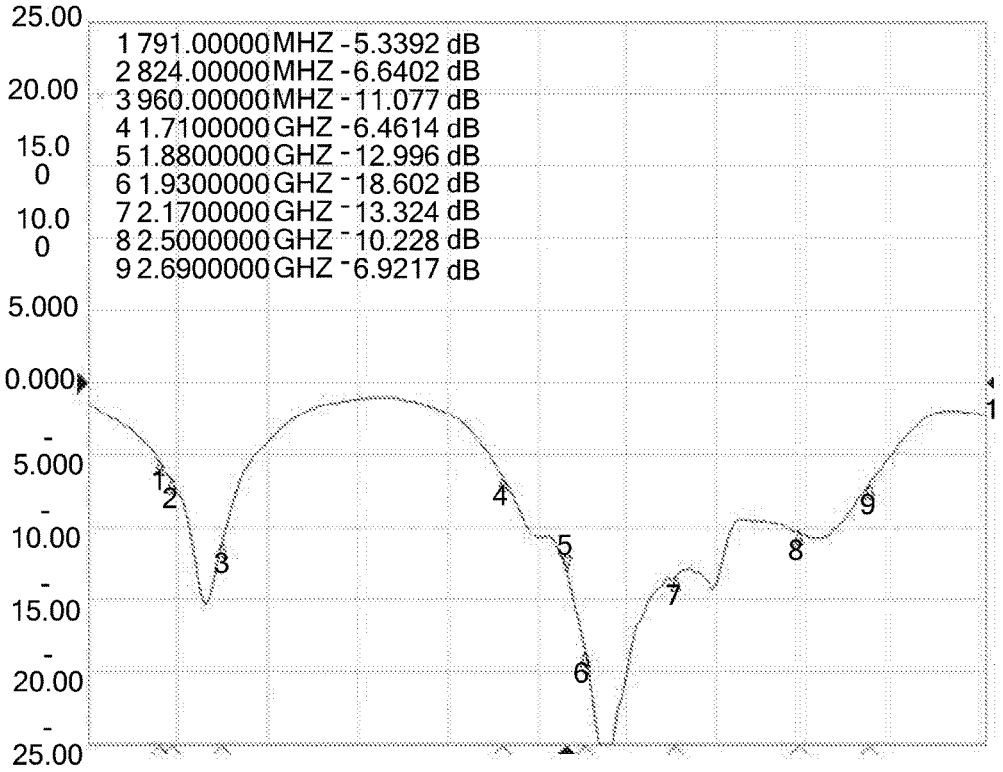
FIG. 4 is an exemplary diagram of a band characteristic of a printed circuit board antenna according to Embodiment 1 of the present invention.

FIG. 4 is an exemplary diagram of a band characteristic of a printed circuit board antenna according to Embodiment 1 of the present invention; as a curve of a test result of a reflection factor S11, FIG. 4 shows a band characteristic of a printed circuit board antenna according to an embodiment of the present invention, and relates to a structure shown in FIG. 2. The curve in FIG. 4 indicates a relationship between a reflection factor and an operating frequency when the printed circuit board antenna is fed, where an impedance characteristic of a microstrip feeder that is electrically connected to the feeding point may be 50 ohms.

A frequency coverage range of the curve is 600 megahertz (MHz)-3 gigahertz (GHz); in the entire coverage range, two frequency bands 791-960 MHz and 1710-2690 MHz of an LTE product are included, and reflection factors of the two frequency bands in the diagram are less than −5 dB, where 0 dB represents a case of total reflection. Generally, antenna performance is acceptable when a reflection factor is less than −5 dB, and a smaller reflection factor value indicates better performance. For example, on the curve, a coordinate value of a point 1 is (791 MHz, −5.339 dB), a coordinate value of a point 3 is (960 MHz, −11.077 dB), a coordinate value of a point 4 is (1710 MHz, −6.461 dB), and a coordinate value of a point 9 is (2690 MHz, −6.922 dB).

Figure 1:
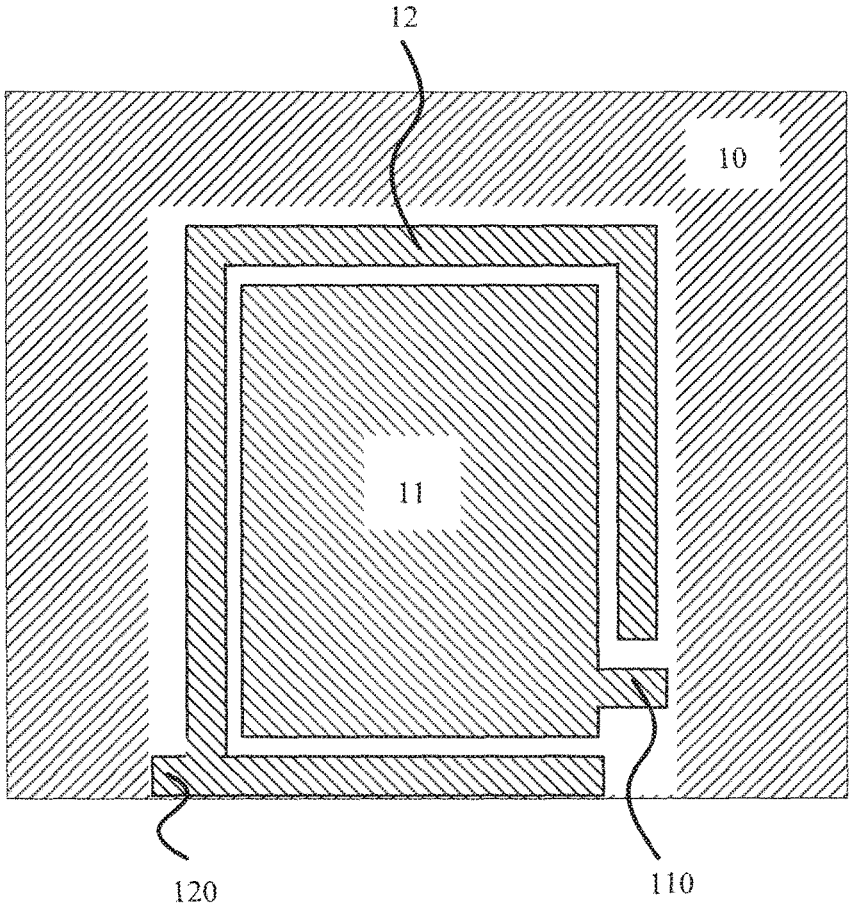
FIG. 1 (PRIOR ART)
FIG. 1 is a schematic structural diagram of a printed circuit board antenna in the prior art.
Figure 5:
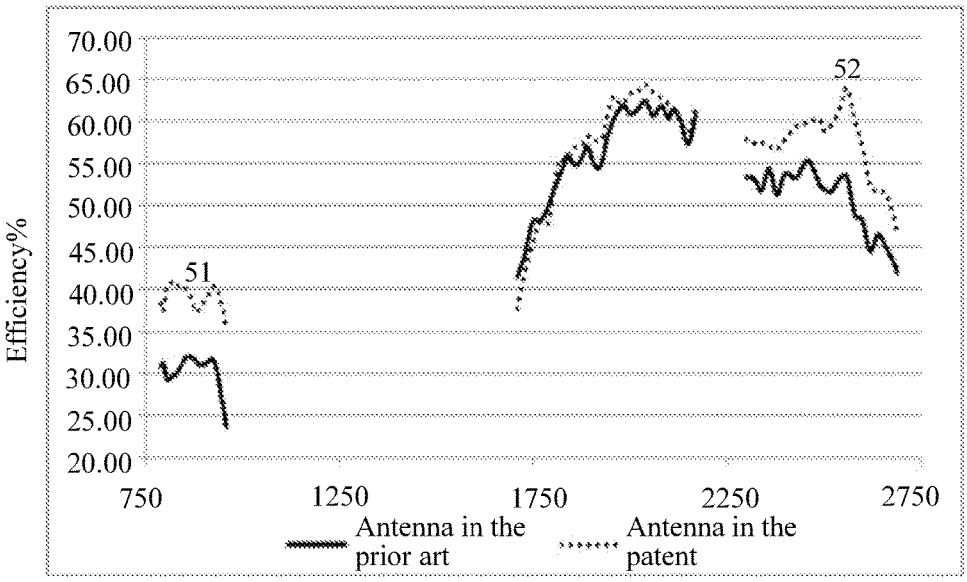
FIG. 5 is a performance diagram of a printed circuit board antenna according to Embodiment 1 of the present invention.

The printed circuit board antenna structure shown in FIG. 1 in the prior art and the printed circuit board antenna in the present invention are separately disposed by using a same board, and an impedance characteristic of a microstrip feeder on the board is 50 ohms, and a comparative difference in efficiency is shown in FIG. 5. A curve 51 shows efficiency fluctuation of a grounding part in the printed circuit board antenna structure in the present invention, and a curve 52 shows efficiency fluctuation of a coupling interdigital part in the printed circuit board antenna structure in the present invention. It can be learned from an actual measurement that in a low frequency band and a frequency band around 2600 MHz, efficiency of the printed circuit board antenna in the present invention is superior to the printed circuit board antenna in the prior art, where the curve 51 has at least 5% gain compared with the antenna in the prior art, and the curve 52 also has at least 4% gain compared with the antenna in the prior art, which indicates that the printed circuit board antenna in the present invention plays an important role in improving antenna performance and enhancing a wireless receiving and sending capability of an entire system.

An embodiment of the present invention further provides a printed circuit board antenna, and the printed circuit board antenna includes a feeding part, a coupling interdigital part, and a grounding part, where the feeding part includes a first straight line segment type, a feeding point, and at least a first branch, where the first branch extends out from one side of the first straight line segment type, and the feeding point is located on an opposite side of the straight line segment type and the first branch; the coupling interdigital part includes a second straight line segment type and at least a second branch, where the second branch extends out from one side of the second straight line segment type, the first branch alternates with the second branch, and there is a gap between the first branch and the second branch; the grounding part is a ring with an opening, where the grounding part surrounds the feeding part and the coupling interdigital part, a gap is formed between the grounding part and the feeding part, a gap is formed between the grounding part and the coupling interdigital part, the feeding point extends out from the opening, and there is a grounding point in a part that the outside of the grounding part contacts with a printed circuit board.

It can be seen that the printed circuit board antenna includes the feeding part, the coupling interdigital part, and the grounding part. The feeding part and the coupling interdigital part are in an interdigital layout structure, which improves efficiency, and in particular, low-frequency efficiency, on the basis of a small-sized printed antenna, and may implement LTE full-frequency coverage without matching; in addition, a high-frequency Smith chart is more convergent, and improvement of high-frequency band efficiency is more obvious.

It should be noted that a ring or a loop mentioned in the foregoing embodiments may be a rectangular ring or a rectangular loop, and certainly, may also be another ring or loop, which is not limited in the embodiments of the present invention.

Finally, it should be noted that the foregoing embodiments are merely intended for describing the technical solutions of the present invention other than limiting the present invention. Although the present invention is described in detail with reference to the foregoing embodiments, persons of ordinary skill in the art should understand that they may still make modifications to the technical solutions described in the foregoing embodiments or make equivalent replacements to some technical features thereof, without departing from the scope of the technical solutions of the embodiments of the present invention.

What is claimed is:

1. A printed circuit board antenna, comprising:

a feeding part comprising a first straight line segment type and a first branch, wherein the first branch extends out from one side of the first straight line segment type;

a coupling interdigital part comprising a second straight line segment type and a second branch, wherein the second branch extends out from one side of the second straight line segment type, wherein the first straight line segment type of the feeding part and the second straight line segment type of the coupling interdigital part are about parallel, and wherein a first gap is formed between the first branch of the feeding part and the second branch of the interdigital part; and a grounding part, wherein a second gap is formed between the grounding part and the feeding part, wherein a third gap is formed between the grounding part and the coupling interdigital part, wherein an opening is provided on the grounding part, wherein a feeding point of the feeding part extends out from the opening, and wherein the grounding part comprises a ring that surrounds an outside of the feeding part and the coupling interdigital part.

2. The printed circuit board antenna according to claim 1, wherein the second branch and the first branch are disposed in an opposite alternation manner.

3. The printed circuit board antenna according to claim 2, wherein a length of the first branch is equal to a length of the second branch.

4. The printed circuit board antenna according to claim 2, wherein a length of the first branch is unequal to a length of the second branch.

5. The printed circuit board antenna according to claim 2, wherein a first gap distance between the first branch and the second branch is equal.

6. The printed circuit board antenna according to claim 2, wherein a first gap distance between the first branch and the second branch is unequal.

7. The printed circuit board antenna according to claim 2, wherein a second gap distance between the grounding part and the feeding part s equal.

8. The printed circuit board antenna according to claim 2, wherein a second gap distance between the grounding part and the feeding part is unequal.

9. The printed circuit board antenna according to claim 2, wherein a third gap distance between the grounding part and the coupling interdigital part is equal.

10. The printed circuit board antenna according to claim 2, wherein a third gap distance between the grounding part and the coupling interdigital part is unequal.

11. The printed circuit board antenna according to claim 1, wherein the grounding part comprises a rectangular ring, and wherein the coupling interdigital part is fully enclosed within the rectangular ring.

12. The printed circuit board antenna according to claim 11, wherein a grounding point is further disposed on the outside of the grounding part.

13. The printed circuit board antenna according to claim 1, wherein the coupling interdigital part is electrically isolated from and physically separated from both the feeding part and the grounding part.

14. A printed circuit board, comprising:

a printed circuit board antenna, wherein the printed circuit board antenna comprises:

a feeding part comprising a first straight line segment type and a first branch, wherein the first branch extends out from one side of the first straight type;

a coupling interdigital part comprising a second straight line segment type and a second branch, wherein the second branch extends out from one side of the second straight line segment type, wherein the first straight line segment type of the feeding part and the second straight line segment type of the coupling interdigital part are about parallel, and wherein a first gap is formed between the first branch of the feeding part and the second branch of the coupling interdigital part; and a grounding part, wherein a second gap is formed between the grounding part and the feeding part, wherein a third gap is formed between the grounding part and the coupling interdigital part, wherein an opening is provided on the grounding part, wherein a feeding point of the feeding part extends out from the opening, and wherein the grounding part comprises a ring that surrounds an outside of the feeding part and the coupling interdigital part.

15. The printed circuit board according to claim 14, wherein the second branch and the first branch are disposed in an opposite alternation manner.

16. The printed circuit board according to claim 14, wherein the grounding part comprises a rectangular ring, and wherein the coupling interdigital part is fully enclosed within the rectangular ring.

17. The printed circuit board according to claim 14, wherein a grounding point is further disposed on the outside of the grounding part.

18. The printed circuit board according to claim 14, wherein a microstrip feeder is configured on the printed circuit board, and wherein the microstrip feeder is electrically connected to the feeding point.

19. The printed circuit board according to claim 18, wherein an impedance characteristic of the microstrip feeder is 50 ohms.

20. The printed circuit board according to claim 14, wherein the coupling interdigital part is electrically isolated from and physically separated from both the feeding part and the grounding part.

* * * * *